US012674245B2

(12) United States Patent
Lee et al.

(10) Patent No.: US 12,674,245 B2
(45) Date of Patent: Jul. 7, 2026

(54) HIGH-STRENGTH STEEL SHEET HAVING EXCELLENT SURFACE QUALITY AND MANUFACTURING METHOD THEREFOR

(71) Applicant: POSCO CO., LTD, Pohang-si (KR)

(72) Inventors: Kang-Min Lee, Gwangyang-si (KR); Chung-Hwan Lee, Gwangyang-si (KR); Ki-Cheol Kang, Gwangyang-si (KR); Nam-A Kim, Gwangyang-si (KR); Yoon-Mo Jang, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 252 days.

(21) Appl. No.: 18/681,653

(22) PCT Filed: Sep. 15, 2022

(86) PCT No.: PCT/KR2022/013778

§ 371 (c)(1),
(2) Date: Feb. 7, 2024

(87) PCT Pub. No.: WO2023/043216

PCT Pub. Date: Mar. 23, 2023

(65) Prior Publication Data

US 2024/0368796 A1 Nov. 7, 2024

(30) Foreign Application Priority Data

Sep. 16, 2021 (KR) ..... 10-2021-0123764

(51) Int. Cl.
*B32B 15/04* (2006.01)
*B32B 17/06* (2006.01)
(Continued)

(52) U.S. Cl.
CPC ..... *C25D 5/50* (2013.01); *C22C 38/002* (2013.01); *C22C 38/02* (2013.01); *C22C 38/04* (2013.01); *C22C 38/06* (2013.01); *C25D 3/12* (2013.01)

(58) Field of Classification Search
CPC ..... C25D 3/12; C22C 38/08
(Continued)

(56) References Cited

U.S. PATENT DOCUMENTS

2009/0162691 A1 6/2009 Ishizuka et al.
2015/0118411 A1* 4/2015 Cardenas ..... C25F 3/24 427/532

(Continued)

FOREIGN PATENT DOCUMENTS

CN 101163811 A 4/2008
CN 111334796 A 6/2020

(Continued)

OTHER PUBLICATIONS

International Search Report dated Dec. 9, 2022, issued in International Patent Application No. PCT/KR2022/013778 (with English translation).

(Continued)

*Primary Examiner* — Lauren R Colgan
(74) *Attorney, Agent, or Firm* — Morgan Lewis & Bockius LLP

(57) ABSTRACT

The present invention relates to a high-strength steel sheet having excellent surface quality due to improved coatability thereof and a method for manufacturing same.

14 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C25D 3/12*** | (2006.01) |
| ***C25D 5/50*** | (2006.01) |

(58) Field of Classification Search
USPC ..... 428/701, 702
See application file for complete search history.

(56) References Cited

U.S. PATENT DOCUMENTS

| | | | | |
|---|---|---|---|---|
| 2017/0369974 | A1* | 12/2017 | Kim | C21D 8/0226 |
| 2018/0371570 | A1* | 12/2018 | Kim | C21D 6/008 |
| 2020/0123674 | A1* | 4/2020 | Allely | C21D 9/46 |
| 2020/0216927 | A1* | 7/2020 | Jin | C22C 38/06 |
| 2020/0232083 | A1* | 7/2020 | Morishita | B32B 15/013 |
| 2020/0325554 | A1* | 10/2020 | Takeda | C21D 6/001 |

FOREIGN PATENT DOCUMENTS

| | | | |
|---|---|---|---|
| JP | 2019-504196 | A | 2/2019 |
| JP | 2020-521041 | A | 7/2020 |
| KR | 10-2011-0087800 | A | 8/2011 |
| KR | 10-2013-0077907 | A | 7/2013 |
| KR | 10-2015-0073029 | A | 6/2015 |
| KR | 10-1630976 | B1 | 6/2016 |
| KR | 10-1736640 | B1 | 5/2017 |
| KR | 10-2017-0075126 | A | 7/2017 |
| KR | 10-1808445 | B1 | 12/2017 |
| KR | 10-2019-0077178 | A | 7/2019 |
| KR | 10-1999013 | B1 | 7/2019 |
| KR | 10-2020-0092351 | A | 8/2020 |
| KR | 10-2021-0000027 | A | 1/2021 |

OTHER PUBLICATIONS

Office Action dated Feb. 12, 2025 issued in corresponding Japanese Patent Application No. 2024-505380.

Extended European Search Report dated Feb. 28, 2025 issued in corresponding European Patent Application No. 22870300.5.

Office Action dated Mar. 16, 2026 issued in the corresponding Chinese Patent Application No. 202280062394.6 with the English translation. (Note: KR 2011-0087800 A, KR 2019-0077178 A, KR 10-2020-0092351 A, and CN 111492075 A already submitted).

* cited by examiner

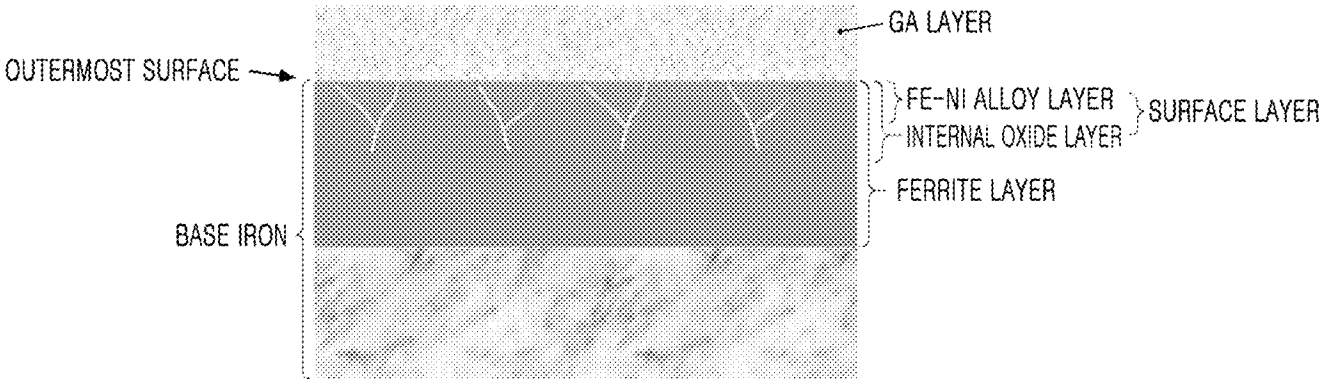
OUTERMOST SURFACE
GA LAYER
FE-NI ALLOY LAYER
INTERNAL OXIDE LAYER
SURFACE LAYER
FERRITE LAYER
BASE IRON

HIGH-STRENGTH STEEL SHEET HAVING EXCELLENT SURFACE QUALITY AND MANUFACTURING METHOD THEREFOR

CROSS-REFERENCE OF RELATED APPLICATIONS

This application is the U.S. National Phase under 35 U.S.C. § 371 of International Patent Application No. PCT/KR2022/013778, filed on Sep. 15, 2022, which in turn claims the benefit of Korean Application No. 10-2021-0123764, filed on Sep. 16, 2021, the disclosure of which applications are incorporated by reference herein.

TECHNICAL FIELD

The present disclosure relates to a high-strength steel sheet having excellent surface quality and a manufacturing method therefor.

BACKGROUND ART

Transformation Induced Plasticity (TRIP) steel, a Giga-level high forming steel, has elongation superior to other Giga-level steels by utilizing an austenite phase, but there may be a problem in that liquid metal embrittlement (LME) may occur due to Si added at a level of 1.5 wt % for high forming during welding.

The LME phenomenon is a phenomenon in which liquid zinc (Zn) penetrates into a grain boundary of a surface layer portion of base iron during spot welding of the steel to lead to an occurrence of cracks, and these cracks are accelerated, which is greatly affected by an heat input and thermal stress during spot welding, and a ratio of C and Si in the steel.

In order to suppress this LME phenomenon, an attempt was made to improve the properties of a material by applying an oxidation-reduction method in which the steel is oxidized at around 600° C. and then reduced again at 700 to 800° C. during an annealing heat treatment, in the process of manufacturing TRIP steel, or applying a method of suppressing internal oxidation of oxidizing elements (Mn, Si, etc.) by adding antimony (Sb), tin (Sn), or the like into steel.

However, even if the aforementioned methods are applied, there is a disadvantage that the effect of improving the LME phenomenon is not very significant.

Accordingly, there is a need for measures to improve plating properties and surface quality by significantly suppressing the LME phenomenon of the TRIP steel containing a certain amount of oxidizing elements.

PRIOR ART DOCUMENT (Patent Document 1) Korean Patent No. 10-1630976

SUMMARY OF INVENTION

Technical Problem

An aspect of the present disclosure is to provide a high-strength steel sheet having excellent surface quality by suppressing a LME cracking phenomenon by minimizing a surface enrichment of Mn and Si present in steel, and a manufacturing method therefor.

Meanwhile, the object of the present disclosure is not limited to the description above. An object of the present disclosure may be understood from the overall contents of the present specification, and it can be understood by those of ordinary skill in the art that there would be no difficulty in understanding the additional problems of the present disclosure.

Solution to Problem

According to an aspect of the present disclosure, a high-strength steel sheet having excellent surface quality includes:

a base steel sheet; and a ferrite layer formed on a surface layer portion of the base steel sheet, wherein the ferrite layer has an internal oxide layer on an upper portion thereof, the internal oxide layer having an Fe—Ni alloy layer formed thereon, the internal oxide layer is formed to a maximum depth of 3 μm in a thickness direction along a grain boundary of a matrix structure of the base steel sheet from a surface of the ferrite layer, and the Fe—Ni alloy layer is formed in the internal oxide layer to a maximum depth of 2 μm in the thickness direction along the grain boundary of the matrix structure of the base steel plate from the surface of the ferrite layer.

According to another aspect of the present disclosure, a manufacturing method for a high-strength steel sheet having excellent surface quality includes: preparing a base steel sheet; forming a Ni+Fe/rGO composite coating layer on at least one surface of the base steel sheet; and performing an annealing heat treatment on the base steel sheet having the composite coating layer formed thereon, wherein the annealing heat treatment is performed at a temperature range of at most 850° C. and a dew point temperature of −10 to +5° C.

Advantageous Effects of Invention

According to an aspect of the present disclosure, a LME phenomenon may be suppressed more effectively than conventional technologies to suppress the LME phenomenon of TRIP steel, and specifically, the formation of oxides near a steel surface may be minimized, thereby providing a high-strength steel sheet having improved surface quality as well as plating properties of the TRIP steel.

BRIEF DESCRIPTION OF DRAWINGS

FIG. 1 is a view schematically illustrating a cross-section in a thickness direction of a high-strength steel sheet according to an example embodiment of the present disclosure.

BEST MODE FOR INVENTION

The present inventors have studied in depth ways to effectively suppress the problem in which TRIP steel containing a certain amount of oxidizing elements may cause defects such as an LME phenomenon through surface enrichment of the oxidizing elements during a welding process although the TRIP steel has excellent ductility and is suitable for high forming.

From the results, the present inventors have confirmed that upon manufacturing the TRIP steel, Ni coating may be performed prior to an annealing heat treatment, while a specific material is further added during the Ni coating to form a composite coating layer, and simultaneously, a subsequent annealing heat treatment process may be optimized to fundamentally suppress surface enrichment of the oxidizing elements, and have completed the present disclosure.

Hereinafter, the present disclosure will be described in detail.

First, according to an aspect of the present disclosure, a high-strength steel sheet having excellent surface quality may include: a base steel sheet; and a ferrite layer formed on a surface layer portion of the base steel sheet, and the ferrite layer has an internal oxide layer on an upper portion thereof on which an Fe—Ni alloy layer is formed.

The above-described base steel sheet is TRIP steel having high strength, and an alloy composition thereof is not particularly limited, but as an example, the base steel sheet may include: by wt %, carbon (C): 0.17 to 0.19%, silicon (Si): 1.3 to 1.7%, manganese (Mn): 2.4 to 2.7%, aluminum (Al): 0.01 to 0.7%, phosphorus (P): 0.01% or less, sulfur(S): 0.003% or less, residual Fe and other inevitable impurities.

Carbon (C) is a decisive element added to secure strength and stabilize residual austenite. In order to sufficiently obtain the above-described effect, carbon (C) may be included in an amount of 0.17% or more, but when the content of carbon (C) is excessive, there may be a problem in which weldability may be degraded, and accordingly, in consideration of the problem, the content may be limited to 0.19% or less.

Silicon (Si) is an element suppressing the precipitation of carbides in ferrite and promoting the diffusion of carbon in the ferrite into austenite, which serves to contribute to the stabilization of residual austenite. In order to sufficiently obtain the above-described effect, silicon (Si) may be included in an amount of 1.3% or more, but when the content of silicon (Si) is excessive, there may be a problem in which rollability may be deteriorated and plating properties may be degraded by forming Si oxide on a surface of the steel plate, and accordingly, in consideration of the problem, the content may be limited to 1.7% or less.

Manganese (Mn) is an element contributing to the formation and stabilization of residual austenite, and is an effective element in securing strength and ductility. In order to obtain the above-described effect, it may be advantageous to include Mn in an amount of 2.4% or more, but when the content is excessive, there may be a problem in which mechanical properties may be degraded by segregation caused by casting and hot rolling processes, and accordingly, in consideration of the problem, the content may be limited to 2.7% or less.

Aluminum (Al) is an element added for deoxidation of steel, which is effective in stabilizing residual austenite by suppressing the precipitation of cementite. When the content of aluminum (Al) is less than 0.01%, the deoxidation effect is insufficient to deteriorate the cleanliness of the steel. On the other hand, in order to increase an stabilization effect of residual austenite, it may be advantageous to include Al in an amount of 0.1% or more, but when the content exceeds 0.7%, castability and plating adhesiveness of the steel may be degraded.

Phosphorus (P) is an element for solid solution strengthening, but when the content of phosphorus (P) is excessive, brittleness of the steel may occur, and accordingly, an upper limit of phosphorus (P) may be limited to 0.01%.

Sulfur(S) is an impurity element in steel, which may impair ductility and weldability of the steel, and accordingly, the content of sulfur(S) may be limited to 0.003% or less.

The remaining component of the present disclosure is iron (Fe). However, since the unavoidable impurities from a raw material or a surrounding environment may inevitably be incorporated in a normal manufacturing process, the unavoidable impurities may not be excluded. Since these impurities are known to those skilled in the conventional manufacturing process will know, not all of these impurities are specifically mentioned in this specification.

That is, the present disclosure has technical significance in minimizing surface enrichment of oxidizing elements such as Mn and Si present in the steel, targeting steel containing a certain amount of oxidizing elements such as Mn and Si.

The high-strength steel sheet of the present disclosure includes a ferrite layer formed on a surface layer portion of the base steel sheet, and the ferrite layer may have an internal oxide layer formed on an upper portion thereof on which a Fe—Ni alloy layer is formed (see FIG. 1).

First of all, the surface layer portion of the base steel sheet may be referred to as a region by at most 50 μm, and more advantageously, at most 30 μm in the thickness direction of the base steel sheet from an outermost surface of the ferrite layer. Accordingly, in the present disclosure, the ferrite layer may be present by at most 50 μm, preferably at most 30 μm, into the base steel plate, based on the thickness direction of the base steel plate. In the ferrite layer, the internal oxide layer may be formed to a maximum depth of 3 μm in the thickness direction along a grain boundary of a matrix structure of the base steel sheet from a surface of the ferrite layer, and the Fe—Ni alloy layer may be formed in the internal oxide layer to a maximum depth of 2 μm in the thickness direction along the grain boundary of the matrix structure of the base steel plate from the surface of the ferrite layer. In this case, the Fe—Ni alloy layer and the internal oxide layer may be present continuously along the grain boundary at a maximum depth of 2 μm and 3 μm, respectively, from the outermost surface of the ferrite layer, or may be present discontinuously at a certain distance. Here, the grain boundary refers to a grain boundary of the matrix structure of the base steel sheet, and denotes not only a ferrite grain boundary, but also an austenite grain boundary, a bainite grain boundary, and a martensite grain boundary, and it should be noted that the Fe—Ni alloy layer and the internal oxide layer may be present in a grain boundary of at least one of each phase.

The base steel plate may be a plated steel sheet on which a plating layer is present on at least one surface of the base steel sheet through a plating treatment, and in this case, a ferrite layer may be included directly under the plating layer, that is, on an interface between the base steel plate and the plating layer. In this case, a surface directly under the plating layer may be determined as an outermost surface of the ferrite layer.

In the present disclosure, for example, in the case of a GA plated steel sheet, a Fe—Ni alloy layer may be formed inside the plating layer adjacent to the ferrite layer.

As will be described in detail below, the Fe—Ni alloy layer and the internal oxide layer on an upper portion of the ferrite layer may be formed by forming a Ni composite coating layer and then performing an annealing heat treatment process before performing the annealing heat treatment on the base steel sheet.

More specifically, the Ni composite coating layer may be formed from a reduced graphene oxide, that is, a mixture composition of rGO-coated Fe oxide and Ni compound, and Fe oxide in a coating layer formed therefrom may diffuse into the base steel sheet during a subsequent annealing heat treatment process to suppress a surface diffusion of Mn and Si in the steel, whereas the Fe is coupled to Ni which has a faster diffusion into the base steel plate than the Fe, thereby an Fe—Ni oxide layer is formed on a surface.

When examining segregation energy for each element in a Ni—X or Fe—X (where X is Si or Mn)-based crystal grain, both Fe—Si and Fe—Mn are on a level of 10 to 90 KJ/mol, and Ni—Si has a negative value, while Ni—Mn has a positive value. In other words, Mn has a condition in which segregation is easy to occur in a Ni—Mn grain boundary, but Mn may be difficult to diffuse to the surface due to the diffusion of Ni into Fe.

On the other hand, the surface diffusion of Si may be easy in this process, but the rGO contained in the Ni composite coating layer may also be diffused into the base, and accordingly, the Si and rGO are present together in the Fe—Ni alloy layer, and due to high oxygen reactivity of pyridinic and graphical present in the rGO, the surface diffusion of oxidizing elements including Si in the steel may be effectively suppressed.

Furthermore, in the annealing heat treatment process, moisture-containing nitrogen is input to increase a dew point, and as a result, Si, Mn, and the like, form an internal oxide layer within a surface layer.

On the other hand, the ferrite layer present on a surface of the base steel sheet may be present to have a thickness of at most 50 μm inside the base steel sheet, based on the thickness direction of the base steel sheet (see FIG. 1).

In the present disclosure, the ferrite layer is formed by a reaction in which oxygen (O) atoms in the internal oxide layer formed in the annealing heat treatment process are bonded to carbon in the steel and decarburized into carbon monoxide (CO).

Since the ferrite layer has a soft property, cracks may be difficult to occur, thereby suppressing the LME phenomenon. In order for this effect to be sufficiently expressed, the ferrite layer may include a ferrite phase having an area fraction of 50% or more.

In the present disclosure, the base steel plate may be a cold rolled steel plate having the aforementioned alloy composition, or a plated steel plate including a plating layer on at least one surface of the cold rolled steel plate.

When the base steel sheet is the plated steel sheet, the plating layer is not particularly limited, but may generally be a zinc-based plating layer, and it should be noted that the plating layer may be formed on an upper portion of the ferrite layer present on the surface of the base steel sheet (cold-rolled steel sheet).

Hereinafter, a manufacturing method for a high-strength steel sheet having excellent surface quality provided by the present disclosure will be described in detail.

Briefly, the manufacturing method may include: preparing a base steel sheet, forming a composite coating layer containing Ni on at least one surface of the base steel sheet, and performing an annealing heat treatment on the base steel sheet having the composite coating layer formed thereon.

Each process condition will be described in detail below.

First of all, the base steel sheet is TRIP steel, as described above, and an alloy composition thereof is not particularly limited, but as an example, the base steel sheet may include: by wt %, carbon (C): 0.17 to 0.19% by weight, silicon (Si): 1.3 to 1.7%, manganese (Mn): 2.4 to 2.7%, aluminum (Al): 0.01 to 0.7%, phosphorus (P): 0.01% or less, sulfur(S): 0.003% or less, residual Fe, and other inevitable impurities.

It should be noted that the base steel plate may be a cold rolled steel plate, and the description of each element is replaced with the above-described contents.

A composite coating layer containing Ni, preferably a Ni+Fe/rGO composite coating layer, may be formed on at least one surface of the base steel sheet prepared according to the operations described above.

The Ni+Fe/rGO composite coating layer may be formed from a coating composition produced by manufacturing a nickel (Ni) compound and an Fe/rGO aqueous solution, respectively, and then mixing the same.

First, reduced graphene oxide, rGO, is produced. The rGO may be obtained by oxidizing graphite and reducing graphene oxide (GO) including oxygen (O) atoms on a surface.

Specifically, based on 200 ml of a solution in which graphene oxide (GO) is dispersed at 0.001 to 0.01 g per 1 ml of distilled water, 1 to 10 ml of hydrazine monohydrate is added and maintained at high temperature. Thereafter, 50 to 100 ml of sulfuric acid may be added thereto and then sonicated, thereby manufacturing the rGO.

In this case, the process of maintaining the high temperature may be performed at 70 to 90° C. for 1 to 3 hours, and the sonicating treatment may be performed for 20 to 40 minutes. When the maintenance process is performed at a temperature exceeding 90° C. for more than 3 hours, the amount of evaporated water may be excessive, which may make it difficult to obtain an appropriate level of solution. Furthermore, when the sonicating treatment may be performed for less than 20 minutes, it may be difficult to secure a uniform rGO, and since a sonicating process is accompanied again during a subsequent Fe coating process, the sonicating treatment may be performed for 40 minutes or less in consideration of the operation.

The present disclosure may coat the rGO with Fe. The Fe is effective in forming an alloy phase with Ni in a composite coating layer, and the rGO is effective in suppressing the diffusion of a surface layer of oxidizing elements in a base steel sheet.

A process of coating the rGO with Fe may be performed by mixing the rGO produced according to the aforementioned operation with an aqueous iron (Fe) oxide solution and then sonicating the mixed solution.

Specifically, based on rGO 10 ml/L, 1 to 10 mg/L of aqueous solution saturated with $FeSO_4$ or $FeCl_3$ hydrate and the rGO were added to 100 to 500 ml of pure water and mixed, followed by sonication for 60 to 600 minutes, thereby obtaining Fe/rGO including at most 3 wt % of nano-sized Fe oxide. When the sonicating treatment time is less than 60 minutes, the Fe-coated rGO may not be formed smoothly due to the insufficient amount of Fe coating, but when the sonicating treatment time exceeds 600 minutes, Fe coating may be difficult to perform.

By the above-described sonicating process, the Fe oxide may be coated in a size of several tens of nanometers (nm), and preferably, the size thereof may be 10 to 50 nm.

A coating composition for forming a composite coating layer may be produced by mixing a nickel (Ni) compound with the Fe/rGO aqueous solution produced as described above.

Specifically, based on 10 ml of the Fe/rGO aqueous solution, a Watts bath comprised of 1 to 1.5 M (mol) of $NiSO_4$, 0.1 to 0.5 M of $NiCl_2$, and 0.1 to 0.5 M $H_3BO_3$ may be produced, and the Fe/rGO aqueous solution may be added to the Watt bath, thereby obtaining a Ni+Fe/rGO coating composition.

The Ni+Fe/rGO coating composition may have a pH of 1 to 2. As described above, the pH of the coating composition may be adjusted to the aforementioned range, thus uniformly dispersing the graphene (rGO) included in the composition in the coating layer. By uniformly dispersing the rGO in the coating layer, corrosion resistance, electrical and physical properties of the steel plate may be improved.

When the amount of Fe/rGO aqueous solution added to the Watts bath is excessive, there may be a problem in that a large amount of immersion occurs, making it difficult to ensure solution stability.

In the present disclosure, the Ni+Fe/rGO coating composition prepared according to the operation may be coated on at least one surface of the previously prepared base steel sheet, and in this case, an intended Ni+Fe/rGO composite coating layer may be formed from a coating treatment through electroplating.

When the composite coating layer is formed through the electroplating, the electroplating may be performed in an adhesion amount of 200 to 800 mg per unit area ($m^2$) based on an adhesion amount of Ni. When the adhesion amount of Ni is less than 200 mg per unit area, the diffusion of the surface layer of the oxidizing elements in the steel may not be effectively suppressed, but when the adhesion amount of Ni exceeds 800 mg, an effect thereof is saturated and economically disadvantageous. More advantageously, the electroplating may be performed in an adhesion amount of 400 mg or more per unit area ($m^2$).

During the electroplating, as the temperature of the solution increases, the electrical conductivity increases to improve the plating efficiency. However, when the temperature thereof exceeds 60° C., because the amount of solution evaporation increases significantly, the electroplating may be performed at a temperature of 60° C. or less, and in order to obtain a certain level of electrical conductivity, it may be advantageous to perform the electroplating at a temperature of 30° C. or more.

The electroplating may be completed to perform an annealing heat treatment on the base steel sheet having a Ni+Fe/rGO composite coating layer formed on at least one surface thereof.

The annealing heat treatment may be performed at a dew point temperature of −10 to +5° C. and a temperature range of at most 850° C. in order to promote internal oxidation while suppressing diffusion of the surface layer of the oxidizing elements in the base steel sheet.

When the dew point temperature exceeds +5° C. during the annealing heat treatment, there may be a concern that base iron itself is oxidized. However, when the temperature is excessively low, there may be a problem that the plating performance deteriorates, and accordingly, a lower limit of the dew point temperature may be limited to −10° C. in consideration of the problem.

Heat treatment may be performed in a temperature range of at most 850° C., preferably 750 to 850° C., when performing annealing in an annealing furnace in which the atmosphere is controlled as described above. When the temperature is less than 750° C. during the heat treatment, there may be a concern that internal oxidation may not sufficiently occur, but when the temperature exceeds 850° C., there may be a concern that decarbonization may become excessive to deteriorate tensile properties.

On the other hand, moisture-containing nitrogen may be added when a temperature is increased by, preferably 700° C. or more, in a heating section, during heating for the annealing heat treatment. This is meant to induce internal oxidation and decarburization of oxidizing elements, and it may be advantageous to add the moisture-containing nitrogen in an amount of 50 to 200 $m^3$/h. In this case, when the amount of added moisture-containing nitrogen is less than 50 $m^3$/h, an internal oxide layer may be partially formed due to an insufficient rising effect of the dew point, but the decarbonization may be difficult to induce, but when the amount thereof exceeds 200 $m^3$/h, a dew point temperature exceeds 5° C. and excessively increases, which may cause the base iron itself to be oxidized.

In the present disclosure, a Fe oxide coated on the rGO of the Ni+Fe/rGO composite coating layer formed on at least one surface of the base steel sheet by performing the annealing heat treatment under the conditions described above is reduced to Fe in a surface layer by a reducing atmosphere in a annealing furnace, and a portion of the reduced Fe is diffused into the base steel sheet.

In this case, Ni in the composite coating layer forms an Fe—Ni oxide layer in a surface layer as Ni is diffused into Fe.

Furthermore, surface enrichment of oxidizing elements (Mn, Si, etc.) present in the steel is suppressed by the Fe—Ni oxide layer, whereas the oxidizing elements is oxidized by water vapor in nitrogen in an annealing furnace atmosphere or by pyridinic and graphitic of the rGO, thus forming an internal oxide layer.

Both the Fe—Ni oxide layer and the internal oxide layer may be formed along a grain boundary, and may be formed in sizes (lengths) of a maximum of 2 μm and a maximum of 3 μm, respectively.

In an annealing heat treatment process, since the internal oxide layer is formed instead of an annealed enrichment material, water vapor is dissociated into 0 atoms on the surface layer of the base steel sheet, followed by a reaction in which the O atom is combined with carbon (C) in the steel and decarbonized into carbon monoxide (CO). As a result, a ferrite layer of a certain thickness is formed on a surface of the base steel plate toward the inside of the base steel plate, and the ferrite layer includes an internal oxide layer formed an upper portion thereof, the internal oxide layer having an Fe—Ni alloy layer formed therein. Accordingly, there is a ferrite layer having the internal oxide layer on which the Fe—Ni oxide layer is formed, on the surface layer of the base steel sheet, thereby minimizing the propagation of cracks, and accordingly, the occurrence of the LME phenomenon may be inhibited.

MODE FOR INVENTION

Hereinafter, the present disclosure will be described in more detail with reference to embodiments. However, it should be noted that the following embodiments are only intended to illustrate the present disclosure in more detail, and are not intended to limit the scope of the present disclosure. This is because the scope of the present disclosure is determined by the matters described in the claims and the matters reasonably inferred therefrom.

Embodiment

A cold rolled steel sheet (TRIP steel) having a thickness of 1.5 mm and including: by wt %, 0.18% C-1.5% Si-2.5% Mn-0.05% Al-0.05% Al-0.005% P-0.0015% S (residual Fe and inevitable impurities) was prepared, and one surface of the cold rolled steel sheet was coated.

A coating composition for the coating treatment was produced as follows.

<Producing rGO>

After slowly adding 10 ml of hydrazine monohydrate to a graphene oxide dispersion (200 ml) in which 0.01 g of graphene oxide (GO) was dispersed per ml of distilled water, and the solution was stirred at 80° C. for 2 hours. Thereafter, sulfuric acid was added to the solution and then sonicated for 30 minutes to obtain a solution in which rGO in which graphene oxide was reduced was dispersed.

<Producing Coating Composition>

10 ml of the prepared rGO solution and 10 mg/L of aqueous solution in which $FeSO_4$ hydrate was saturated were added to 500 ml of pure water and were mixed together, and then the mixture was sonicated for 60 minutes to obtain an Fe/rGO aqueous solution. In this case, the Fe/rGO was produced so that Fe oxide of 10 nm was contained at 3 wt %.

Then, 10 ml of the Fe/rGO aqueous solution was added to a Watt bath in which nickel sulfate (26.7 g, 1 M), nickel chloride (64.9 g, 0.5 M), and boric acid (30.4 g, 0.5 M) were dissolved, followed by stirring for 1 hour, to obtain a Ni+Fe/rGo coating composition with a pH of 1.

The Ni+Fe/rGo coating composition produced according to the operation was coated on one side surface of the aforementioned base steel sheet, and in this case, electroplating was performed at 50° C. with a Ni adhesion amount of 200 to 800 mg/m$^2$.

Then, each base steel sheet coated with different Ni adhesion was subjected to an annealing heating treatment by increasing a temperature by 850° C. in an annealing furnace including nitrogen at 3 to 5% by volume. In this case, a dew point temperature was applied at −50° C., −10° C., or +5° C., and 100 m$^3$/h of moisture-containing nitrogen was added in a 700° C. section.

Table 1 below shows results of analyzing the contents of Mn and Si from an outermost surface of each specimen to 100 nm in a thickness direction by GDS after performing electroplating and an annealing heat treatment. In this case, the Ni+Fe/rGo coating composition was used to compare results according to the presence or absence of Fe/rGO, along with a change in Ni adhesion amount during the electroplating and dew point temperature during the annealing heat treatment.

TABLE 1

| Condition | | Element | | | | | | | |
|---|---|---|---|---|---|---|---|---|---|
| | | Mn | | | | Si | | | |
| Dew Point (° C.) | | −50 | −50 | −10 | +5 | −50 | −50 | −10 | +5 |
| Fe/rGO (ml/L) | | 0 | 10 | 10 | 10 | 0 | 10 | 10 | 10 |
| Ni adhesion amount (mg/m$^2$) | 0 | 1.059 | 0.318 | 0.350 | 0.360 | 0.328 | 0.203 | 0.199 | 0.197 |
| | 200 | 0.556 | 0.312 | 0.322 | 0.325 | 0.253 | 0.229 | 0.159 | 0.132 |
| | 400 | 0.439 | 0.314 | 0.303 | 0.300 | 0.232 | 0.266 | 0.148 | 0.104 |
| | 800 | 0.284 | 0.308 | 0.294 | 0.288 | 0.212 | 0.204 | 0.113 | 0.078 |

(The unit of each element in Table 1 is wt % × μm)

As illustrated in Table 1 above, when the coating composition is a Ni+Fe/rGO coating composition compared to a Ni composition alone, it may be confirmed that the enrichment of Mn and Si on the surface is greatly suppressed.

In addition, it may be seen that as the dew point temperature increases and the Ni adhesion amount increases, the tendency to suppress the surface diffusion of the oxidizing elements increases.

Table 2 below shows results of measuring a depth ((m) of the internal oxide layer of each specimen after the electroplating and the annealing heat treatment. In this case, the Ni+Fe/rGo coating composition was used to compare results according to the presence or absence of Fe/rGO, along with a change in Ni adhesion amount during the electroplating and dew point temperature during the annealing heat treatment. The depth of the internal oxide layer was measured by cutting the specimen in a direction, perpendicular to a rolling direction, and then observing a cross-section thereof with SEM.

TABLE 2

| Dew Point (° C.) | | −50 | −50 | −10 | +5 |
|---|---|---|---|---|---|
| Fe/rGO (ml/L) | | 0 | 10 | 10 | 10 |
| Ni adhesion amount (mg/m$^2$) | 0 | — | — | 0.8 ± 0.3 | 1.2 ± 0.5 |
| | 200 | — | — | 1.2 ± 0.5 | 1.6 ± 0.7 |
| | 400 | — | 1.1 ± 0.4 | 2.1 ± 0.8 | 2.5 ± 1.2 |
| | 800 | — | 0.5 ± 0.2 | 1.4 ± 0.4 | 1.8 ± 0.5 |

As shown in Table 2, it may be formed that the internal oxide layer is not observed when a coating composition is Ni alone. On the other hand, in a case of using a Ni+Fe/rGO coating composition, at the dew point temperature of −50° C., the internal oxide layer is observed when the Ni adhesion amount is 400 mg/m$^2$ or more, and at the dew point temperature of −10° C. and +5° C., internal oxide layer is formed to a maximum of 2.5±1.2 μm as the Ni adhesion amount of increased.

On the other hand, when the adhesion amount is 800 mg/m$^2$, it may be seen that a thickness of the internal oxide layer is reduced compared to 400 mg/m$^2$. This is confirmed to be due to the formation of a residual layer by causing some Ni to remain without diffusion as the coating layer becomes relatively thick.

Table 3 below shows results of measuring a ferrite fraction (area %) from an outermost surface of each specimen to 50 μm in the thickness direction after performing electroplating and an annealing heat treatment. In this case, the Ni+Fe/rGO coating composition was used to compare the results according to the presence or absence of Fe/rGO, along with the change in Ni adhesion amount during the electroplating and the dew point temperature during the annealing heat treatment.

TABLE 3

| Dew Point (° C.) | | −50 | −50 | −10 | +5 |
|---|---|---|---|---|---|
| Fe/rGO (ml/L) | | 0 | 10 | 10 | 10 |
| Ni adhesion amount (mg/m$^2$) | 0 | — | — | 33.0 | 49.0 |
| | 200 | — | 6.5 | 51.3 | 68.3 |
| | 400 | — | 28.7 | 65.0 | 78.5 |
| | 800 | — | 17.8 | 57.8 | 72.8 |

As illustrated in Table 3, it may be seen that when the coating composition is Ni alone, decarburization is not generated at all. In addition, it can be seen that as the dew point temperature increases and the Ni adhesion amount increases, decarburization occurs advantageously, thereby increasing a ferrite fraction.

Table 4 below shows results of observing the surface quality of each specimen after electroplating and annealing heat treatment and then alloying hot-dip galvanizing. In this case, the hot-dip galvanizing treatment was performed through hot-dip galvanizing treatment using a normal galvanizing bath and then alloying heat treatment at 480° C.

Furthermore, the Ni+Fe/rGo coating composition was used to compare the results according to the presence or absence of Fe/rGO, along with the change in Ni adhesion amount during the electroplating and dew point temperature during the annealing heat treatment. In this case, a non-plated state was observed using a surface microanalyzer, and a specimen in which the non-plated state was not observed was determined as 'good.'

TABLE 4

| Dew Point (° C.) | | −50 | −50 | −10 | +5 |
|---|---|---|---|---|---|
| Fe/rGO (ml/L) | | 0 | 10 | 10 | 10 |
| Ni adhesion | 0 | Not plated | Not plated | Not plated | Good |
| amount | 200 | ζ + δ | η phase | Good | Good |
| (mg/m$^2$) | 400 | ζ + δ | Good | Good | Good |
| | 800 | δ phase coarse | Good | Good | Good |

As shown in Table 4, when a coating composition is Ni alone, a non-plated state occurred or an alloying degree became poor regardless of the Ni adhesion amount. In other words, there was no surface improvement effect at all.

On the other hand, when the Ni+Fe/rGo coating composition was used, at the dew point temperature of −50° C., a surface was improved when the Ni adhesion amount was 400 mg/m$^2$ or more, and at the dew point temperature of −10° C., the surface was improved from when the adhesion amount was 200 mg/m2 or more, and at the dew point temperature of +5° C., the surface quality was good regardless of the Ni adhesion amount.

The invention claimed is:

1. A high-strength steel sheet having excellent surface quality, comprising:

a base steel sheet; and a ferrite layer formed on a surface layer portion of the base steel sheet, wherein the ferrite layer has an internal oxide layer on an upper portion thereof, the internal oxide layer having an Fe—Ni alloy layer formed thereon, the internal oxide layer is formed to a maximum depth of 3 μm in a thickness direction along a grain boundary of a matrix structure of the base steel sheet from a surface of the ferrite layer, and the Fe—Ni alloy layer is formed in the internal oxide layer to a maximum depth of 2 μm in the thickness direction along the grain boundary of the matrix structure of the base steel plate from the surface of the ferrite layer.

2. The high-strength steel sheet having excellent surface quality of claim 1, wherein the ferrite layer is present in a thickness of at most 50 μm inside the base steel sheet based on a thickness direction of the base steel sheet.

3. The high-strength steel sheet having excellent surface quality of claim 2, wherein the ferrite layer includes a ferrite phase having an area fraction of 50% or more.

4. The high-strength steel sheet having excellent surface quality of claim 1, wherein the ferrite layer is present in a thickness of at most 30 μm inside the base steel sheet based on a thickness direction of the base steel sheet.

5. The high-strength steel sheet having excellent surface quality of claim 1, wherein a reduced graphene oxide (rGO) is further included in the Fe—Ni alloy layer.

6. The high-strength steel sheet having excellent surface quality of claim 1, wherein the base steel sheet is a cold rolled steel sheet including: by wt %, carbon (C): 0.17 to 0.19%, silicon (Si): 1.3 to 1.7%, manganese (Mn): 2.4 to 2.7%, aluminum (Al): 0.01 to 0.7%, phosphorus (P): 0.01% or less, sulfur(S): 0.003% or less, residual Fe and other inevitable impurities.

7. The high-strength steel sheet having excellent surface quality of claim 1, further comprising:

a plating layer formed on a surface of the ferrite layer, wherein an Fe—Ni alloy layer is formed in the plating layer in contact with the ferrite layer.

8. A manufacturing method for a high-strength steel sheet having excellent surface quality, the method comprising:

preparing a base steel sheet;

forming a Ni+Fe/rGO composite coating layer on at least one surface of the base steel sheet; and performing an annealing heat treatment on the base steel sheet having the composite coating layer formed thereon, wherein the annealing heat treatment is performed at a temperature range of at most 850° C. and a dew point temperature of −10 to +5° C.

9. The manufacturing method for a high-strength steel sheet having excellent surface quality of claim 8, wherein Fe/rGO of the composite coating layer has Fe oxide coated on a surface of rGO.

10. The manufacturing method for a high-strength steel sheet having excellent surface quality of claim 8, wherein the forming the composite coating layer comprises:

i) producing rGO;

ii) mixing the produced rGO with an iron oxide aqueous solution and sonicating the aqueous solution;

iii) forming a coating composition by mixing the sonicated aqueous solution with a nickel compound; and iv) electroplating the coating composition on at least one surface of the base steel sheet.

11. The manufacturing method for a high-strength steel sheet having excellent surface quality of claim 10, wherein the coating composition has a pH of 1 to 2.

12. The manufacturing method for a high-strength steel sheet having excellent surface quality of claim 10, wherein the electroplating is performed in an adhesion amount of 200 to 800 mg per unit area (m$^2$) based on an adhesion amount of Ni.

13. The manufacturing method for a high-strength steel sheet having excellent surface quality of claim 8, wherein when a heating temperature is 700° C. or more during the annealing heat treatment, 50 to 200 m$^3$/h of moisture-containing nitrogen is added.

14. The manufacturing method for a high-strength steel sheet having excellent surface quality of claim 8, wherein the base steel sheet is a cold rolled steel sheet including: by wt %, carbon (C): 0.17 to 0.19%, silicon (Si): 1.3 to 1.7%, manganese (Mn): 2.4 to 2.7%, aluminum (Al): 0.01 to 0.7%, phosphorus (P): 0.01% or less, sulfur(S): 0.003% or less, residual Fe and other inevitable impurities.

* * * * *